United States Patent [19]

Shigaki

[11] Patent Number: 4,495,872

[45] Date of Patent: Jan. 29, 1985

[54] INCINERATOR AND METHOD OF REDUCING $NO_x$ EMISSIONS

[75] Inventor: Masanobu Shigaki, Ibaragi, Japan

[73] Assignee: Kabushiki Kaisha Takuma, Osaka, Japan

[21] Appl. No.: 584,221

[22] Filed: Feb. 27, 1984

[30] Foreign Application Priority Data

Aug. 28, 1981 [JP] Japan ..... 56-135970

[51] Int. Cl.[3] ..... F23N 5/02

[52] U.S. Cl. ..... 110/190; 110/188; 110/257; 110/346; 236/15 BB; 236/15 E

[58] Field of Search ..... 110/185, 186, 188, 190, 110/255, 257, 346, 245; 236/15 BD, 15 E, 15 BB

[56] References Cited

U.S. PATENT DOCUMENTS 3,812,794 5/1974 Taylor ..... 110/257
4,182,246 1/1980 Lombana et al. ..... 110/188
4,385,567 5/1983 Voss ..... 110/347

FOREIGN PATENT DOCUMENTS 27816 3/1981 Japan ..... 110/245
37411 4/1981 Japan ..... 110/245
100221 8/1981 Japan ..... 110/245

*Primary Examiner*—Edward G. Favors
*Assistant Examiner*—Steven E. Warner
*Attorney, Agent, or Firm*—Griffin, Branigan & Butler

[57] ABSTRACT

In a low $NO_x$ emission incinerator a refuse supply stoker (1), a dry-ignition stoker (2), a gas generation stoker (3), and a complete combustion stoker (4) are positioned in descending stair-step fashion beneath a combustion chamber (A). In the dry ignition stoker (2) and the gas generation stoker (3) refuse is thermally decomposed under an amount of air which is less than the amount of air theoretically required for complete combustion, so that reducing gases such as CO, $NH_3$, and the like are generated. At the complete combustion stoker (4) the residuum of the refuse is completely combusted under an amount of air greater than the required theoretical amount. Air is supplied through nozzles (7,8,9) at successive points above the flow route of combustion gas inside the combustion chamber (A) so that the temperature in the combustion chamber (A) is maintained in a range to reduce the amount of $NO_x$ generated by the combustion of gases.

4 Claims, 2 Drawing Figures

INCINERATOR AND METHOD OF REDUCING $NO_x$ EMISSIONS

BACKGROUND OF THE INVENTION

The present invention relates to improvements in a stoker-type incinerator for refuse such as municipal refuse comprising household and/or industrial wastes, and more particularly to an improved stoker-type incinerator that remarkably reduces the generation of $NO_x$.

Conventional prior art stoker-type incinerators typically comprise a dry stoker D; a combustion stoker E; a post-combustion stoker F; and, a waste heat boiler G all as shown in FIG. 1. The temperature of exhaust gas in the upper area of a combustion chamber A is detected by a temperature detector B. The amount of cold air blown into the combustion chamber A through a nozzle C is adjusted by signals from the temperature detector B. Cold air is introduced to keep the temperature inside the incinerator lower than approximately 950° C. so that the generation of $NO_x$ is reduced by the oxidizing combustion of refuse. In prior art incinerators of this type the amount of $NO_x$ present in exhaust gas is maintained at about 120–130 ppm, which is lower than the value currently prescribed by most governmental regulations (such as the maximum value of 250 ppm set by current Japanese law, for example).

In view of recent environmental trends, it is anticipated that more stringent regulations will be enacted, with the result that the level of permitted $NO_x$ emissions will be lowered to the neighborhood of 80–100 ppm. It is contemplated that prior art methods of controlling the temperature in conventional incinerators will prove ineffectual for complying with such stringent $NO_x$ emission standards. Improved or special equipment will be required for further reduction of $NO_x$ emissions.

To reduce the content of $NO_x$ exhaust gases, processes such as catalyst methods and noncatalytic reduction methods have been developed. Both of these methods are subject to problems. For example, the shortcomings of the catalyst method involve high capital expenditures for equipment as well as high operational costs. In addition, the methods are extremely complicated in operation. With regard to the noncatalytic reduction methods (such as ammonia contact reduction method, for instance), while the $NO_x$ emission level can be reduced to 80–100 ppm, high operational costs are involved in the usage of chemical agents.

To overcome the problems associated with the catalyst methods and the noncatalytic reduction methods, other methods currently under study attempt to precisely control the combustion of refuse placed on a stoker and hence reduce the amount of $NO_x$ without requiring the installation of a special $NO_x$ removing system. However, none of these methods have yet been successful in reducing the amount of $NO_x$ to a level lower than 100 ppm.

Accordingly, it is an object of the present invention to provide a stoker-type incinerator that remarkably reduces the amount of $NO_x$ contained in exhaust gas by a simple combustion system which does not employ catalysts or chemical agents.

SUMMARY OF THE INVENTION

In a low $NO_x$ emission incinerator a refuse supply stoker, a dry-ignition stoker, a gas generation stoker, and a complete combustion stoker are positioned in descending stair-step fashion beneath a combustion chamber. In the dry ignition stoker and the gas generation stoker refuse is thermally decomposed under an amount of air which is less than the amount of air theoretically required for complete combustion, so that reducing gases such as CO, $NH_3$, and the like are generated. At the complete combustion stoker the residuum of the refuse is completely combusted under an amount of air greater than the required theoretical amount. Air is supplied through nozzles at successive points above the flow route of combustion gas inside the combustion chamber so that the temperature in the combustion chamber is maintained in a range to reduce the amount of $NO_x$ generated by the combustion of gases.

In accordance with the method of the invention and apparatus for carrying out the same, after the refuse is first thermally decomposed (under an amount of air which is less than the theoretical amount of air) to generate reducing gases, the residuum of the refuse is completely combusted to obtain ashes containing a small amount of the unburnt matter. In this respect, the amount of $NO_x$ generated by combustion at the stokers is reduced. Moreover, the supply of air to the combustion chamber at successively spaced locations reduces the amount of $NO_x$ generated by the combustion of gases in the combustion chamber.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
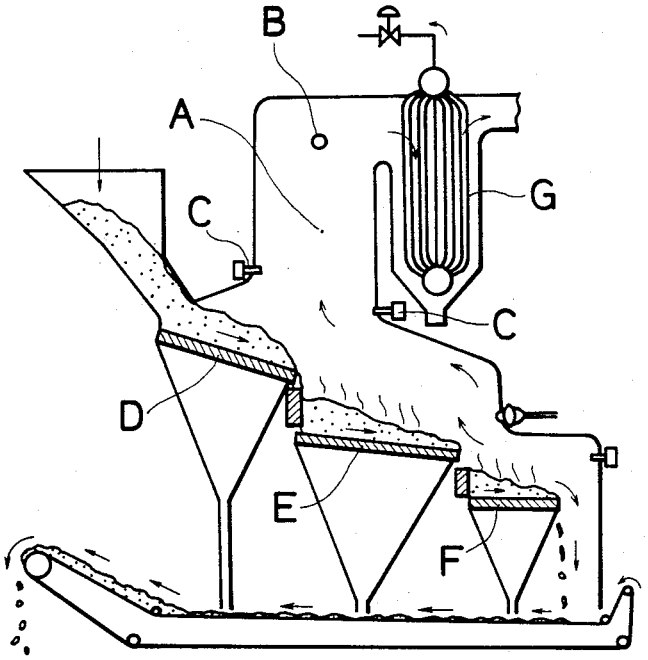
FIG. 1 is a vertical sectional view of a conventional prior art stoker-type incinerator.
Figure 2:
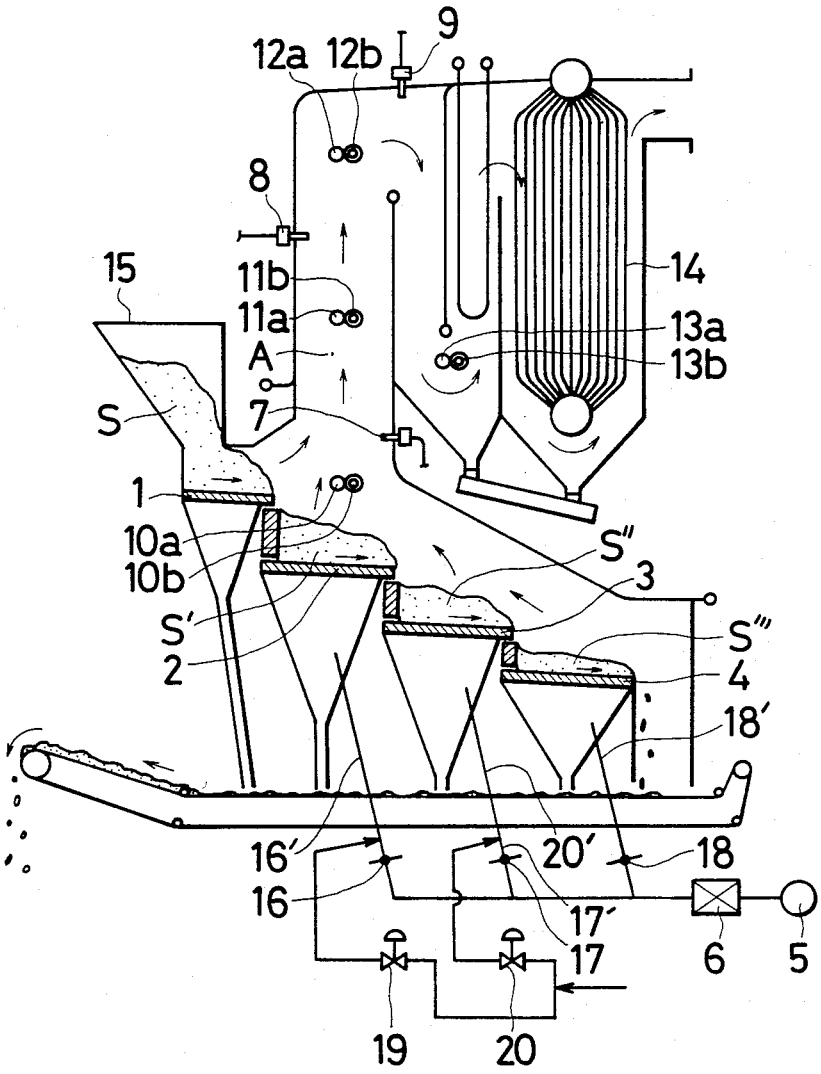
FIG 2 is a vertical sectional view of an embodiment of an incinerator according to the present invention.

FIG. 2 illustrates an embodiment of an incinerator according to the present invention. The incinerator comprises a refuse supply stoker 1; a dry-ignition stoker 2; a gas generator stoker 3; a complete combustion stoker 4; a forced draft fan 5; an air heater 6; air blow nozzles 7, 8, and 9; temperature detectors 10*a*, 11*a*, 12*a*, and 13*a*; gas analyzing meters 10*b*, 11*b*, 12*b*, and 13*b*; a waste heat boiler 14; and, a refuse supply hopper 15.

The incinerator of FIG. 2 is constructed so that high temperature air supplied by the forced draft fan 5 and heated by the air heater 6 is selectively and separately communicated through ducts 16', 18', and 20' from beneath each of the respective stokers 2, 3, and 4. The stokers 2, 3, and 4 are serially arranged in a stair-step fashion of descending horizontal elevation, stoker 2 having the greatest horizontal elevation of the stokers 2, 3, and 4. In other respects the stokers 2, 3, and 4 are installed near the bottom of the incinerator in conventional fashion.

As seen hereinafter, when necessary high temperature steam is selectively supplied from beneath the dry-emission stoker 2 and the gas generator stoker 3. The steam is produced by the waste heat boiler 14. Air volume adjustment dampers 16, 17, and 18 positioned in ducts 16', 17', and 18', respectively, have opening angles which are automatically controlled by signals from a thermometer 10*a* and a gas analyzing meter 10*b*. The detector means comprising thermometer 10*a* and the gas analyzing meter 10*b* are installed above the stoker region but beneath an overhead combustion chamber A. Steam volume adjustment valves 19 and 20 are positioned to govern the amount of steam introduced into the ducts 16' and 20', respectively. The valves 19 and 20 are controlled by signals from the thermometer 10*a* and the gas analyzing meter 10*b* positioned beneath the combustion chamber A.

A temperature detectors 11*a*, 12*a*, and 13*a*, and gas analyzing meters 11*b*, 12*b* and 13*b* are all installed at regular intervals along the flow route of combusted gas inside the combustion chamber A. The amount of air blown through nozzle 7 is automatically controlled by signals from the detector means comprising temperature detector 11*a* and the gas analyzing meter 11*b*; the amount of air blown through nozzle 8 is automatically controlled by signals from the detector means comprising temperature detector 12*a* and the gas analyzing meter 12*b*; and, the amount of air blown through a nozzle 9 is automatically controlled by signals from the detector means comprising temperature detector 13*a* and the gas analyzing meter 13*b*.

OPERATION

With a conventional stoker-type incinerator, only high temperature air is normally supplied from beneath each stoker, and the layers of refuse are made as thin as possible for better combustion. That is, active oxidizing reactions occur on the stokers while the layers of refuse are stirred and turned over. In a conventional stoker-type incinerator the excess air ratio (i.e., the ratio of the amount of air actually supplied to the amount of air theoretically required for essentially complete combustion) of the high temperature air is in the range of approximately 1.7 to 2.4.

With the present invention, the temperature of a refuse layer is raised as high as possible (thus minimizing the $O_2$ content) and high temperature steam is blown in for water-gas reaction (it should be noted, however, that the supply of steam may not be needed for wet refuse). As a result, reducing gases such as $NH_3$ are positively generated on the gas generation stoker 3 by thermal decomposition. In the zone about stoker 3 there is essentially no generation of $NO_x$.

In the complete combustion stoker 4, on the other hand, some $NO_x$ is generated by the oxidizing combustion in the presence of air. Yet the small quantity of resultant $NO_x$ is mixed with reducing gases such as the $NH_3$, etc., generated in the gas generation stoker 3. The chemical reaction of the $NO_x$ with the reducing gases from stoker 3 essentially removes the $NO_x$ gases.

Refuse S fed through a hopper 15 passes through the refuse supply stoker 1 to the dry-ignition stoker 2. The surface of the piled refuse on the stoker 2 is ignited with radiant heat emitted from the combustion chamber A, thus forming the so-called fire source. In addition, a refuse layer S' on stoker 2 is dried with high temperature air supplied from beneath through the duct 16'. At this stage, as stated before, insufficient amounts of air exist inside the refuse layer S', and small quantities of reducing gases are generated.

Next, the refuse layer S' with a fire source set by surface ignition falls into the gas generation stoker 3. On stoker 3 the fire source and unburnt refuse are mixed. Some refuse inside the refuse layer S'' is combusted on the gas generation stoker 3. High temperature air is supplied from beneath stoker 3 through duct 17'. On stoker 3 a so-called gasification treatment occurs by thermal decomposition. Further, a so-called water gas reaction occurs inside the refuse layer S'' with steam blown in through duct 20'. The amount of air supplied through the duct 17'' is enough to maintain the average temperature inside the layer S'' higher than approximately 800° C. by combusting some refuse in the refuse layer S''. The excess air ratio on the stoker 3 is less than 1.

The residuum of the refuse layer S'' on stoker 3 which is sufficiently thermally decomposed falls to the complete combustion stoker 4. Generally speaking, refuse contains more volatile matter and less fixed carbon. Therefore, the combustion quantity passed to the stoker 4 is comparatively small. By supplying a sufficiently high temperature air through a duct 18', a residuum S''' is completely combusted on the stoker 4.

According to one mode involving an experiment for the combustion of municipal refuse, the thickness of refuse layers S' and S'' at the dry-ignition stoker 2 and the gas generation stoker 3, respectively, are preferably in the range of 1.5 to 2.0 meters. The thickness of refuse layer S''' is approximately 30 cm at the complete combustion stoker 4. It is preferred that the temperature of air supplied through the air heater 6 and air volume adjustment dampers 16, 17, and 18 from the forced draft fan 5 be higher than the ignition temperature of the refuse (i.e., higher than approximately 200° C.). According to this mode, air having a temperature in the range of 230° C. to 250° C. is preferred. Moreover, in this mode it is preferred that the high temperature steam be supplied from boiler 14, and that the high temperature steam be supplied to stokers 2 and 3 when necessary through the steam volume adjustment valves 19 and 20. High temperature steam is primarily supplied to the stoker 3, while the supply of high temperature steam to stoker 3 is a preliminary measure.

The air volume adjustment damper 16, 17, and 18 and steam volume adjustment dampers 19 and 20 are controlled by signals from the temperature detector 10*a* and the gas analyzing meter 10*b* for detecting the amount of CO, $NH_3$, $NO_x$, etc. By so controlling the amount of steam and air, the drying, thermal decomposition, and incineration operations are conducted on each stoker under the optimum conditions.

Absent the method and advantages of the present invention, reducing gases generated on stokers such as stokers 2 and 3 are conducted into a combustion chamber where they are abruptly and completely combusted. The principal ingredients of the reducing gases thusly generated as a result of the combustion are CO, $NH_3$, etc., which have combustion temperatures that are comparatively low. When these gases are combusted abruptly in a combustion chamber, a large amount of $NO_x$ is generated. Consequently, the result achieved by reducing $NO_x$ generation on the stokers is counteracted by $NO_x$ generation in the combustion chamber.

Therefore, with the present invention the temperature inside the combustion chamber A is maintained between 800° C. and 900° C. to suppress the generation of $NO_x$. Further, by using a 3-step air volume adjustment to control the combustion of gases a reaction is sufficiently enhanced between whatever small amount of $NO_x$ is generated and the $NH_3$ contained in the generated gases to improve the removal ratio of $NO_x$. Specifically, the signals from the temperature detector 11*a* and the gas analyzing meter 11*b* (both installed at or around the center of the combustion chamber A) automatically control the amount of air supplied through air blow nozzle 7 installed vertically beneath the detector 11*a* and meter 11*b*. The signals from the temperature detector 12*a* and the gas analyzing meter 12*b* both (installed vertically above the center of the combustion chamber A) automatically control the amount of air supplied through a nozzle 8; and, the signals from the temperature detector 13*a* and the gas analyzing meter 13*b* (both installed near the exhaust gas inlet of a waste heat boiler 14) automatically control the amount of air supplied through the nozzle 9 so that reducing gases are finally and completely combusted. The experiment results indicate that the amount of $NO_x$ is exhaust gas is reduced to a level of 50–80 ppm, thus achieving an excellent low $NO_x$ value.

With the present invention as mentioned above, a conventional stoker-type incinerator is basically modified to provide a combustion system allowing a remarkable reduction in the amount of $NO_x$ generated as compared with that of a conventional stoker-type incinerator. As a result of the modifications (1) a gasification treatment of refuse occurs by making the amount of air supplied from beneath the dry-ignition stoker 2 and the gas generation stoker 3 smaller than the theoretical amount of air necessary for combustion; (2) a water gas reaction is caused by adding, when necessary, high temperature steam to the supplied air; and, (3) reducing gases are combusted at specified relatively low temperatures so that combustion of the gases does not occur abruptly.

Therefore, when anti-pollution laws are further tightened as expected, the present invention will eliminate the need to employ special $NO_x$ reduction equipment of the types which either require chemical agents or catalysts, and will result in a remarkable reduction of both the capital expenditures and operating costs associated with stoker-type incinerators.

Furthermore, it should be noted that an incinerator as described in the present invention is automatically operated, and the method of operation is relatively simple and well adapted for conventional stoker-type incinerators.

While the invention has been particularly shown and described with reference to the preferred embodiments thereof, it will be understood by those skilled in the art that various alterations in form and detail may be made therein without departing from the spirit and scope of the invention.

The embodiments of the invention in which a particular property of privilege is claimed are defined as follows:

1. An incinerator comprising:

stoker means comprising at least three stokers, said stokers including an ignition stoker, a gas generation stoker, and a complete combustion stoker, said stokers being installed within said incinerator to have stoker surfaces of successively lower elevations;

a combustion chamber positioned above said stokers;

means for selectively communicating heated air to each of said stokers;

detector means proximate said stoker means for detecting temperature and analyzing gas constituency;

means for controlling the communication of heated air to each of said ignition and gas generation stokers whereby said ignition and gas generation stokers are supplied with an amount of air less than the amount of air theoretically required for essentially complete combustion of refuse on said stokers;

means for selectively controlling the communication of heated air to said complete combustion stoker whereby said complete combustion stoker is supplied with an amount of air greater than the amount of air theoretically required for the essentially complete combustion of refuse on said stoker;

a plurality of further detector means for detecting temperature and analyzing gas constituency, said further detector means being positioned in said combustion chamber at successive points along the flow route of combustion gas inside said combustion chamber;

a plurality of nozzle means for introducing air into said combustion chamber, the introduction of air through said nozzle means being controlled by signals produced by said further detector means whereby the gas generated at said stoker means is combusted in said combustion chamber at a temperature below a predetermined temperature;

means for selectively communicating steam to said ignition stoker and to said gas generation stoker; and, means for controlling the communication of steam to each of said ignition and gas generation stokers, said control means operatively connected to and responsive to signals produced by said detector means proximate said stoker means.

2. The incinerator of claim 1 wherein said temperature in said combustion is in the range of about 800° C. to 900° C.

3. A method of operating a refuse incinerator of a type having stoker means positioned below a combustion chamber, said stoker means comprising at least three stokers including an ignition stoker, a gas generation stoker, and a complete combustion stoker, said stokers being installed within said incinerator to have stoker surface of successively lower elevation, and wherein said method comprises the steps of:

using detector means for detecting temperature and analyzing gas constituency proximate said stoker means;

using a plurality of further detector means for detecting temperature and analyzing gas constituency in said combustion chamber, said further detector means being positioned in said combustion chamber at successive points along the flow route of combustion gas inside said combustion chamber;

selectively controlling the communication of heated air to each of said ignition and gas generation stokers whereby said ignition and gas generation stokers are supplied with an amount of air less than the amount of air theoretically required for essentially complete combustion of refuse on said stokers;

selectively controlling the communication of heated air to said complete combustion stoker whereby said complete combustion stoker is supplied with an amount of air greater than the amount of air theoretically required for the essentially complete combustion of refuse on said stoker;

using a plurality of nozzle means for introducing air into said combustion chamber, the introduction of air through said nozzle means being controlled by signals produced by said further detector means whereby the gas generated at said stoker means is combusted in said combustion chamber at a temperature below a predetermined temperature;

selectively communicating steam to said ignition stoker and to said gas generation stoker; and, controlling the communication of steam to each of said ignition and gas generation stokers, said control means operatively connected to and responsive to signals produced by said detector means proximate said stoker means.

4. The method of claim 3, wherein said temperature in said combustion is in the range of about 800° C. to 900° C.

* * * * *